United States Patent [19]

Kimura

[11] Patent Number: 4,785,284

[45] Date of Patent: Nov. 15, 1988

[54] FIRE MONITORING SYSTEM

[75] Inventor: Tetsuo Kimura, Tokyo, Japan

[73] Assignee: Nittan Company, Ltd., Tokyo, Japan

[21] Appl. No.: 44,757

[22] Filed: May 1, 1987

[30] Foreign Application Priority Data

May 16, 1986 [JP] Japan ..... 61-110581

[51] Int. Cl.[4] ..... G08B 26/00; G08B 29/00

[52] U.S. Cl. ..... 340/505; 340/511; 340/506; 340/521

[58] Field of Search ..... 340/505, 514, 506, 518, 340/525, 825.07, 825.08, 511, 825.29, 825.54, 521

[56] References Cited

U.S. PATENT DOCUMENTS

| | | | |
|---|---|---|---|
| 4,423,410 | 12/1983 | Galvin et al. | 340/505 |
| 4,523,183 | 6/1985 | Frick | 340/511 |
| 4,528,610 | 7/1985 | Payne | 340/505 |
| 4,581,604 | 4/1986 | Kimura et al. | 340/505 |
| 4,658,243 | 4/1987 | Kimura et al. | 340/505 |

FOREIGN PATENT DOCUMENTS

| | | |
|---|---|---|
| 59-202595 | 11/1984 | Japan . |
| 60-164896 | 8/1985 | Japan . |
| 2173024 | 10/1986 | United Kingdom . |

*Primary Examiner*—Donnie L. Crosland

*Attorney, Agent, or Firm*—Hill, Van Santen, Steadman & Simpson

[57] ABSTRACT

A fire monitoring system used in a fire alarm arrangement includes a fire receiver and a plurality of fire sensors connected to signal/power supply zone lines from the fire receiver to a plurality of fire warning zones, the sensors for short-circuiting the respective zone lines with a low impedance in case of a fire. An analog detector having an address is located at a given warning zone among the fire warning zones. The analog detector is connected to the corresponding signal/power supply zone line through an analog sensor controller having an operation circuit for calculating an analog signal obtained by address polling from the analog detector.

4 Claims, 3 Drawing Sheets

FIRE MONITORING SYSTEM

BACKGROUND OF THE INVENTION

1. Field of the Invention

The present invention relates to a fire monitoring system.

2. Description of the Prior Art

A so-called general fire detector and a so-called analog detector are conventionally known for use in monitoring an area for the presence of fire. In a general fire detector, a signal/power supply zone line is short-circuited with low impedance during operation. An analog detector has an address for each sensor and supplies an analog signal corresponding to a quantity such as temperature or smoke concentration to a receiver by address sampling by the receiver. In a fire alarm system disclosed in Japanese Patent Disclosure (Kokai) No. 59-202595, the above fire detectors are used in a single fire receiver at the same time.

The system using an analog detector has many advantages over a system using general ON/OFF type detectors. Such a system can identify an operating detector and can determine a fire by detecting a variation over time of an analog signal of a given analog detector or by comparing it with an analog signal of an adjacent analog detector. Therefore, the system can perform fire monitoring with higher reliability and fewer lines as compared with a system using ON/OFF fire detectors.

As described above, highly reliable fire information can be obtained by installing a fire alarm system using analog detectors to the entire building or the like. However, an operation circuit using a microprocessor such as a CPU and a digital transmitter having relatively large capacities and high transmission speeds are required, hence the system becomes complex and expensive. In addition, it is difficult to install such a fire alarm system in a building where a fire alarm equipment using an ON/OFF fire detector has already been installed.

SUMMARY OF THE INVENTION

It is, therefore, an object of the present invention to provide a fire monitoring system having high reliability at low cost.

It is another object of the present invention to provide a fire monitoring system which can be easily installed in addition to existing ON/OFF fire alarm equipment.

The above objects are achieved in accordance with the principles of the present invention, a fire monitoring system is disclosed herein having a receiver and a plurality of detectors respectively disposed in fire warning zones and capable of sensing various types of conditions or values associated with the presence of fire. The detectors are connected to signal/power supply zone lines extending from the fire receiver to a plurality of fire warning zones, and short-circuit the zone lines with a low impedance in case of a fire. An analog detector having an address is located at a given warning zone among the fire warning zones, and is connected to the corresponding signal/power supply zone line through an analog sensor controller having an operation circuit which calculates an analog signal obtained by address polling by the analog detector.

DESCRIPTION OF THE PREFERRED EMBODIMENTS

An embodiment of a fire monitoring system of the present invention will now be described in detail with reference to the accompanying drawings.

Figure 1:
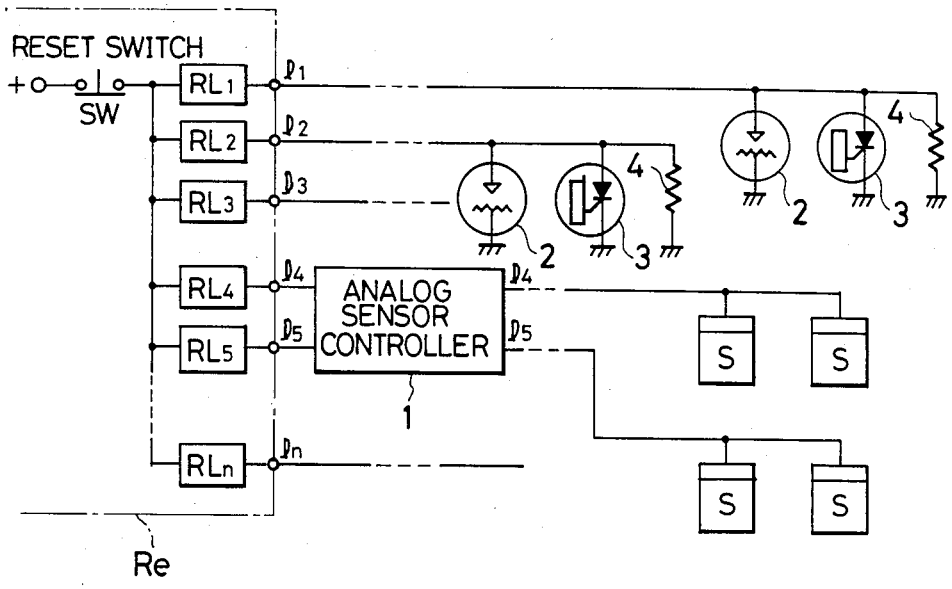
FIG. 1 is a schematic circuit diagram of a fire monitoring system according to an embodiment of the present invention.

FIG. 1 is a schematic circuit diagram of the system of the present invention. In FIG. 1, reference symbol Re denotes a fire receiver, which is conventionally used as a receiver, and which includes zone relays $RL_1$ to $RL_n$ and zone lines $l_1$ to $l_n$ extending from the relays $RL_1$ to $RL_n$ to fire warning zones. The receiver Re also includes a reset switch SW which is provided between a power supply and the zone relays. A power supply, an alarm bell, an operating zone display lamp, and a disconnection detector are used in the system in a known manner, but are not shown in FIG. 1.

Certain of the zone lines $l_1$ to $l_n$ of the fire receiver Re are provided with ON/OFF detectors, while an analog sensor controller 1 is provided for the zone lines $l_4$ and $l_5$ of the zone lines $l_1$ to $l_n$, and analog detectors S having individual adresses are connected to the zone lines $l_4$ and $l_5$ extending from the analog sensor controller 1. Because each analog detector S has an individual address, if the number of addresses of the analog sensor controller 1 is enough, the zone lines $l_4$ and $l_5$ need not be separated but can be used in common. Among the ON/OFF detectors shown in FIG. 1, reference numeral 2 denotes a heat detector and 3 designates a smoke detector. In addition, disconnection detection terminal resistors 4 are connected to terminals of those zone lines $l_1$ to $l_n$ not connected to the controller 1.

The analog detector S may be a smoke detector, but may alternatively be a thermister element which can generate analog outputs, and which supplies analog amounts such as smoke concentration or a temperature as a voltage and a current directly or after A/D conversion to the analog sensor controller 1 by address polling by the analog sensor controller 1, to be described later.

Each analog detector S is installed at a fire warning zone selected in a building where alarm errors are frequently generated. Many of these places are legally required to have a smoke detector installed therein. In a place where a fixed temperature heat detector consisting of a bimetal and the like is installed, less alarm errors are generated. In this embodiment, analog detectors are installed at two warning zones, and the analog sensor controller 1 is provided to cover these two lines. The number of analog detectors may be arbitrarily changed in accordance with circumstances of a building or the like, and the analog sensor controller 1 may be incorporated in the fire receiver Re beforehand or may be provided at each zone line.

Figure 2:
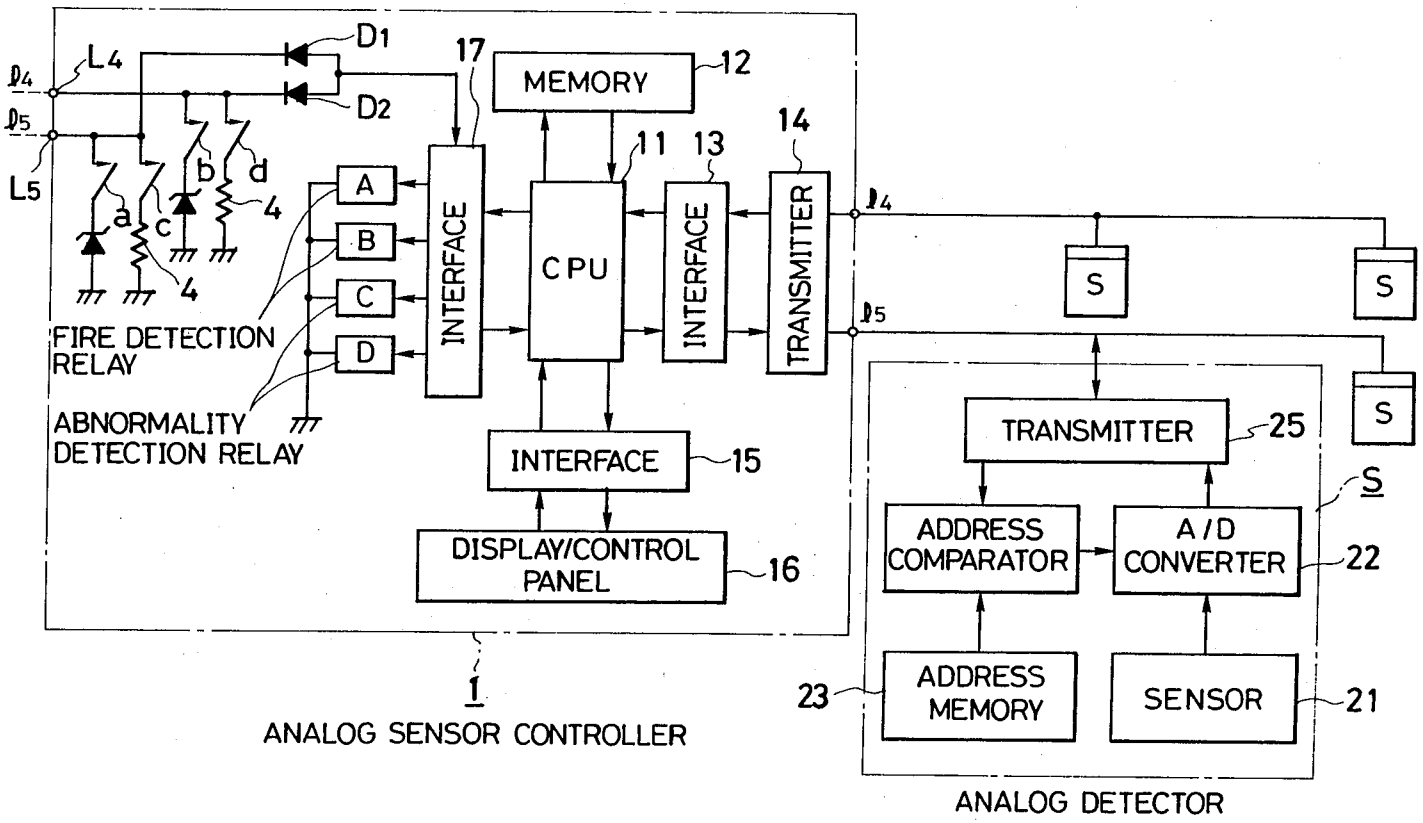
FIG. 2 is a block diagram of an analog sensor controller and an analog detector of FIG. 1.

FIG. 2 is a block diagram of an embodiment of the analog sensor controller 1 and the analog detector S of FIG. 1, in which terminals $L_4$ and $L_5$ are connected to the zone lines $l_4$ and $l_5$ from the fire receiver Re. The analog sensor controller 1 may have its own power source or may use a power source of the fire receiver Re in common. The terminals $L_4$ and $L_5$ are connected to a parallel circuit consisting of a series circuit including normally open contacts a and b of fire signal generation relays A and B and a remaining voltage adjusting Zener diode, and a series circuit including the zone line monitoring terminal resistors 4 and normally open contacts c and d of abnormality detection relays C and D.

The analog sensor controller 1 includes a CPU 11 including a microcomputer or the like, a memory 12 for storing comparison/response data, programs, or the like, an interface 13 between the CPU 11 and a transmitter 14, and an interface 17 for driving the relays A, B, C, and D in accordance with a processing result of the CPU 11, and for initializing a program routine during reset operation of the receiver Re. This initialization is performed such that the voltages of the zone lines $l_4$ and $l_5$ become 0, and outputs from interference preventive diodes $D_1$ and $D_2$ are supplied to the interface 17.

Figure 3:
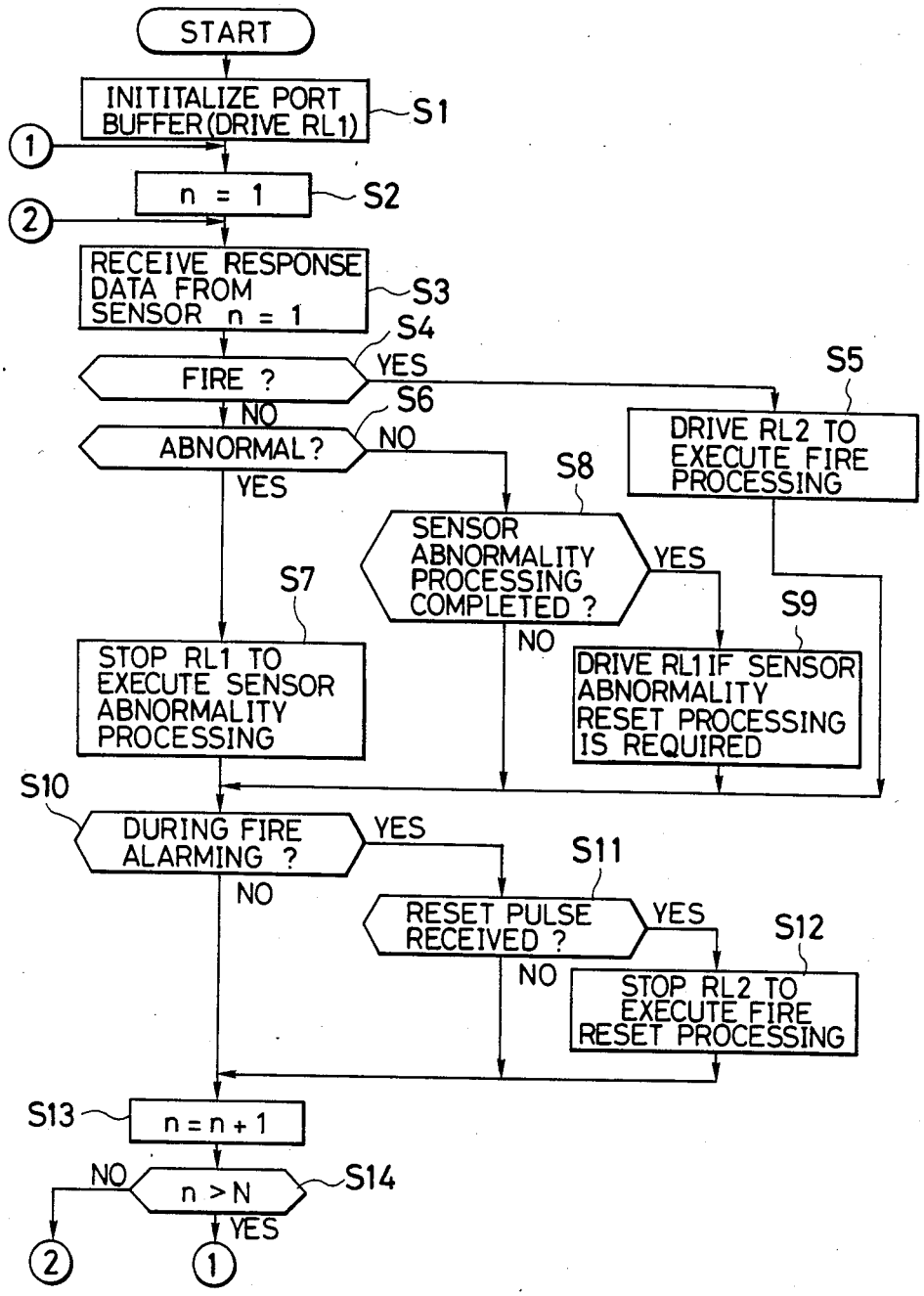
FIG. 3 is a flow chart for explaining the operation of FIG. 2.

The zone lines $l_4$ and $l_5$ connected to the transmitter 14 of the analog sensor controller 1 are connected to the plurality of analog detectors S. Each analog detector S includes a sensor 21 for detecting smoke concentration or a temperature to generate an analog output, and A/D converter 22 for A/D-converting the analog output, an address memory 23, and a transmitter 25. When the analog detector S is subjected to address polling from the analog sensor controller 1, the analog detector S supplies an A/D-converted analog value to the analog sensor controller 1 through the zone line $l_4$ or $l_5$. FIG. 3 is a flow chart for explaining processing of such data received by the analog sensor controller 1.

First, a power supply is turned on to initialize a program routine, and the abnormality detection relays C and D are driven to close the contacts c and d, as shown in step S1 in FIG. 3. Since the contacts c and d are closed, the disconnection detection resistors 4 are connected to the zone lines $l_4$ and $l_5$ extending from the fire receiver Re to the analog sensor controller 1. Accordingly, even if the power supply voltage is not normally applied to the analog sensor controller 1, the receiver Re can detect since the relays C and D do not operate. Then, in step S2, a first analog detector S is set for accessing, and is accessed to fetch analog data therein (step S3). Response data is compared with a comparison value or a differential/integral valus predetermined in step S4. If the CPU 11 determines that a fire is generated, the flow advances to step S5, the fire signal generation relay A (or B) is driven to close its contact a (or b), and the zone line $l_4$ (or $l_5$) is short-circuited with a low impedance to supply the same operation signal as that of the ON/OFF fire detector to the fire receiver Re. At the same time, identification of the analog detector S which detected a fire is supplied through an interface 15 display on a display panel 16 (see FIG. 2) of the analog sensor controller 1. Thereafter, the following analog detectors S are sequentially subjected to polling via steps S10 and S13.

In step S4, if the CPU 11 determines that analog data sent back from the analog detector S does not indicate a fire, the program advances to step S6, and the CPU 11 determines whether an abnormality such as a malfunction of the analog detector S or disconnection has occurred. If "Yes" in step S6, the program advances to step S7 and the abnormality detection relay C (or D) is reset to open its normally closed contact c (or d). The fire receiver Re performs an alarm display similar to a normal disconnection display, and the display panel 16 of the analog sensor controller 1 displays the type of malfunction of the analog detector S (e.g., disconnection of the zone lines $l_4$ and $l_5$ or stop operation of the analog detector S).

Steps S8 and S9, and steps S11 and S12, show a reset operation routine executed after a malfunction of fire is displayed. A reset signal of fire alarm is generated when the reset switch SW of the fire receiver Re is opened, and is applied to the interface 17 through the interference preventive diodes $D_1$ and $D_2$. The signal is initialized when the remaining voltage becomes 0. This is also applicable to initialization executed when the power supply is turned on, but the analog sensor controller may have its own reset switch.

A comparison value or a differential/integral value compared with response data may be arbitrarily changed by a keyboard or the like of the display/control panel 16 even after installation of the analog detector S.

When the analog detector S is used only at a given zone line of fire warning zones of a building where alarm errors are frequently generated, only a small number of analog detectors S is required to cover the same area of the building. Therefore, low data transmission speed from these detectors to the analog sensor controller 1 may be used, and low performance circuits may be used for respective parts. In addition, zone lines used for ON/OFF detectors may be used as the transmission lines.

The fire monitoring system according to the present invention combines advantageous effects of both a fire alarm system using ON/OFF fire detectors and one using analog detectors, is inexpensive and highly reliable, and can easily adapt to existing ON/OFF fire alarm equipment.

Although modifications and changes may be suggested by those skilled in the art it is the intention of the inventor to embody within the patent warranted hereon all changes and modifications as reasonably and properly come within the scope of his contribution to the art.

I claim as my invention:

1. A fire monitoring system for monitoring a plurality of fire warning zones, said system comprising:

a receiver having a plurality of signal/power supply zone lines connected thereto, each zone line leading to a different one of said plurality of fire warning zones;

a plurality of sensors, each sensor being capable of detecting an environmental abnormality characteristic of the presence of fire, each sensor connected to said receiver by a respective signal/power supply zone line and being respectively disposed in one of said fire warning zones, and each sensor including means for short-circuiting a zone line connected thereto with a low impedance in the event said environmental abnormality is sensed;

at least one analog sensor having an address and disposed at one of said warning zones and connected to one of said signal/power supply zone lines; and an analog sensor controller connected to said signal/-power supply zone line of said at least one analog sensor, said analog sensor controller including means for polling the address of said at least one analog sensor and for calculating an analog signal from said analog sensor.

2. A system as claimed in claim 1, wherein said plurality of sensors for detecting an environmental abnormality includes at least one ON/OFF sensor directly connected to a signal/power supply zone line for a zone other than the zone in which said analog sensor is disposed.

3. A system as claimed in claim 1, wherein said analog sensor controller comprises:

at least one fire detection relay respectively connected to each of the signal/power supply zone lines having an analog sensor connected thereto;

at least one abnormality detection relay respectively connected to each of the signal/power supply zone lines having an analog sensor connected thereto;

a memory for storing a fire/abnormality detection program and fire/abnormality reference data; and a central processing unit for accessing each analog detector by address in accordance with said program, said central processing unit including means for comparing response data from the accessed analog sensor with said reference data and for generating a signal when the result of said comparison indicates a fire is present to drive said fire detection relay to short circuit the corresponding zone line with a low impedance and for supplying a fire detection signal to said receiver, and said central processing unit further including means for resetting said abnormality detection relay when the result of said comparison indicates an abnormality has occurred.

4. A system as claimed in claim 3, wherein said analog sensor controller further comprises a display and control panel means for receiving said fire detection signal through a display interface for displaying a signal indicating the presence of a fire, said display and control panel means also including means for setting selected information in said analog sensor controller.

* * * * *